US008944283B2

(12) United States Patent
Shiell

(10) Patent No.: US 8,944,283 B2
(45) Date of Patent: Feb. 3, 2015

(54) MULTIPLE MAGAZINE SELF DISPENSING CONTAINER

(71) Applicant: Aaron C. Shiell, Winnipeg (CA)

(72) Inventor: Aaron C. Shiell, Winnipeg (CA)

( * ) Notice: Subject to any disclaimer, the term of this patent is extended or adjusted under 35 U.S.C. 154(b) by 72 days.

(21) Appl. No.: 13/762,911

(22) Filed: Feb. 8, 2013

(65) Prior Publication Data

US 2013/0206787 A1 Aug. 15, 2013

(51) Int. Cl.
*F41A 9/34* (2006.01)
*F42B 39/00* (2006.01)
*F42B 39/02* (2006.01)

(52) U.S. Cl.
CPC ..... *F42B 39/002* (2013.01); *F42B 39/02* (2013.01)
USPC ..... 221/261; 221/280; 42/80

(58) Field of Classification Search
USPC ..... 221/268, 279, 280, 261; 42/90
See application file for complete search history.

(56) References Cited

U.S. PATENT DOCUMENTS

| | | | | | |
|---|---|---|---|---|---|
| 340,355 | A * | 4/1886 | Ramser | 221/59 |
| 2,203,067 | A * | 6/1940 | Theis | 221/280 |
| 2,226,626 | A * | 12/1940 | Mann | 221/124 |
| 3,189,219 | A * | 6/1965 | Holzworth et al. | 221/131 |
| 3,941,243 | A * | 3/1976 | Yamada | 206/359 |
| 4,515,290 | A * | 5/1985 | Fishler | 221/124 |
| 4,530,445 | A * | 7/1985 | Decker | 221/198 |
| 5,131,563 | A * | 7/1992 | Yablans | 221/92 |
| 5,649,642 | A * | 7/1997 | Mabry et al. | 221/232 |
| 6,000,589 | A | 12/1999 | Burdine | |
| 7,364,057 | B2 * | 4/2008 | Carroll | 224/196 |
| 8,104,640 | B2 * | 1/2012 | Selvetti | 221/154 |
| 2005/0189371 | A1 * | 9/2005 | Harvey | 221/226 |
| 2010/0187271 | A1 | 7/2010 | Selvetti | |
| 2010/0327006 | A1 * | 12/2010 | Campo | 221/185 |

* cited by examiner

*Primary Examiner* — Patrick Mackey
(74) *Attorney, Agent, or Firm* — Kyle R. Satterthwaite; Ryan W. Dupuis; Ade & Company Inc.

(57) ABSTRACT

The multiple magazine self dispensing container is designed to dispense a plurality of partially ejected firearm magazines to the operator in proper orientation to facilitate rapid reloading of a firearm. The container is designed to replace a traditional magazine carrying system or supplement one with extra magazine capacity. A constant force member forces the magazines to come into contact with an incline plane opposite a magazine ejection port. The magazine then partially ejects out the port where it can be removed by the operator.

16 Claims, 12 Drawing Sheets

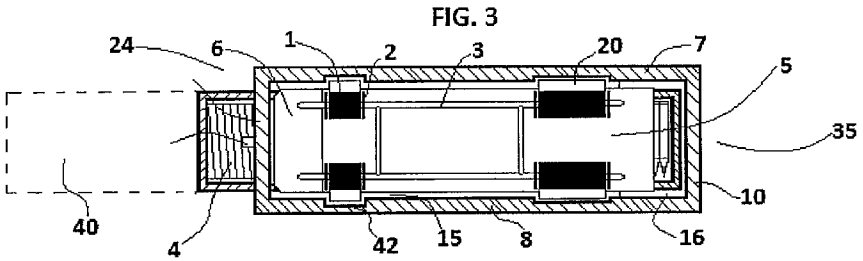
FIG. 3
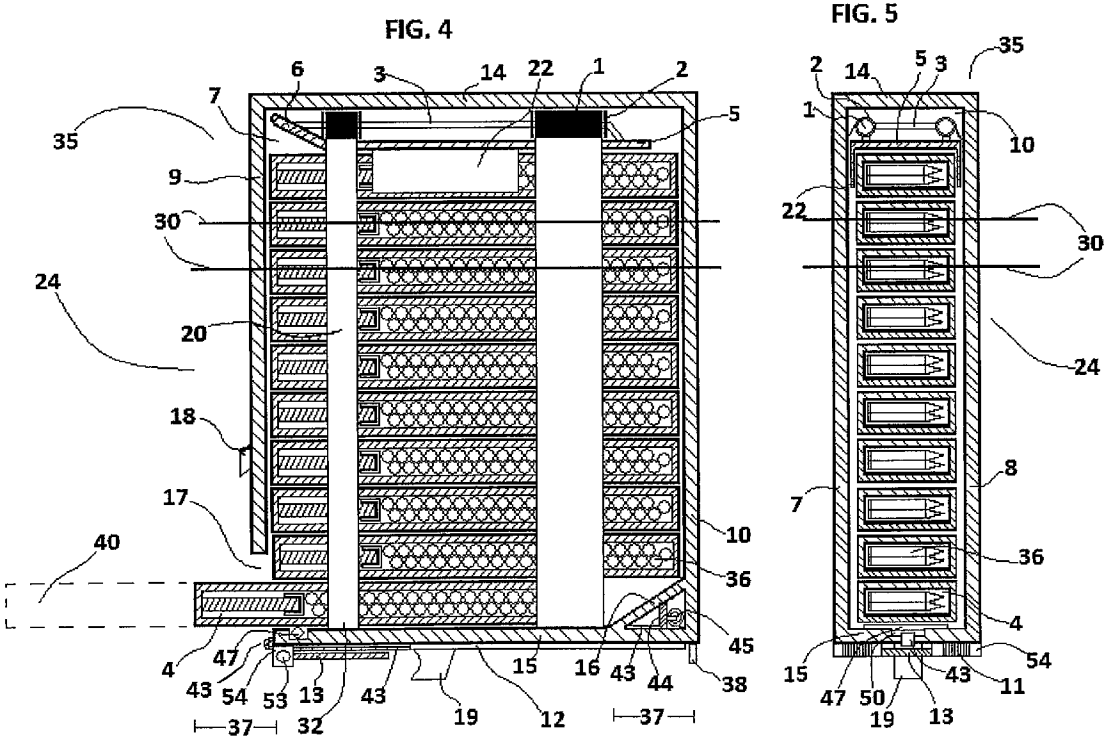
FIG. 4
FIG. 5

MULTIPLE MAGAZINE SELF DISPENSING CONTAINER

CROSS REFERENCE TO RELATED APPLICATIONS

This application claims benefit under 35 U.S.C. 119 of Canadian Patent Application Serial No. 2,768,211, filed Feb. 9, 2012, and Canadian Patent Application Serial No. 2,790,920, filed Aug. 16, 2012.

FIELD OF THE INVENTION

The present invention relates generally to handheld firearms and more specifically a multiple magazine self dispensing container for carrying a series of firearms magazines for a firearm used by the operator. The present multiple magazine self dispensing container is worn on the body in a location and orientation of the operators choosing or mounted relatively stationary in a location accessible to the operator. It automatically and sequentially dispenses in proper orientation magazines to facilitate their rapid loading into a firearm.

BACKGROUND OF THE INVENTION

There are many ways to store and carry weapon magazines and ammunition. Common methods include belts, vests, individual pouches and multiple magazine carriers. The general idea of these inventions is to store ammunition or ammunition magazines to be loaded into a firearm. However the use of individual or multi magazine pouches requires the operator's attention to find and remove the magazines that are usually covered by a flap or require a removal action by the operator. Placing more than one magazine in a pouch increases capacity but makes noise when the magazines come in contact with each other. More often then not, when a reload is required, speed is essential to preventing injury or death. With the currently available types of magazine holders on the market the operator must choose which location to remove a magazine from and remember which magazines are empty and full. This process requires time and focus, which should instead be spent on hostile forces. Multiple magazine systems address these issues by creating a single location from which ammunition magazines are retrieved, but are limited in there capabilities thus far.

Such devices known to the present inventor are identified and discussed in further detail as follows.

U.S. Pat. No. 7,364,057 B2 issued on Apr. 29, 2008 to Sean P. Carroll titled "MULTIPLE MAGAZINE CARRIER AND DISPENSER FOR FIREARMS" describes a carrier and dispenser that dispenses properly orientated magazines to the user. It is relatively long and narrow passage with a elongated compression spring urging the magazines aligned front to back towards a dispensing opening.

U.S. Pat. No. 6,000,589 issued on Dec. 14, 1999 to John M Burdine titled "AUTOMATIC CLIP HOLDER" Describes a box-like structure having a magazine or clip insertion and dispensing slot or opening at one end, with springs disposed in the opposite end to push the magazines or clips toward the dispensing end. It is hooked to the operators belt by use of a clip.

The present invention improves on the prior art solutions, as set out herein further below.

SUMMARY OF THE INVENTION

According to a first aspect of the invention there is provided a multiple magazine self dispensing container that automatically dispenses partially ejected magazines for firearms using ammunition magazines, the multiple magazine self dispensing container comprising:

a container defining an inner compartment having, on respective sides thereof, a front wall, a back wall opposite the front wall, a forward panel, a rearward panel opposite the forward panel, and a bottom panel, the inner compartment being dimensioned for containing a stack of the magazines;

a magazine ejection port on the container located opposite the rearward panel between the forward panel and the bottom panel;

a force application member disposed within the compartment and biased toward the bottom panel to urge the stack of magazines stored within the container toward the bottom panel; and a magazine ejector mounted to the container and operable to automatically convey a lowermost magazine of the stack nearest the bottom panel toward and partially through the magazine ejection port into a partially ejected state protruding from the container.

Preferably the magazine ejector comprises a ramp located inside the inner compartment of the container at a position opposite the magazine ejection port and sloping downwardly from the rearward panel to the bottom panel.

Preferably the force application member is biased toward the bottom panel by one or more spiral spring members acting to draw the force application member toward the bottom panel.

Preferably at least one of the one or more spiral spring members runs along a respective one of the walls and panels and transitions from inside the compartment, where the spring connects to the force application member, to outside the compartment through a spring opening situated in the respective one of the walls or panels at a distance from the bottom panel.

Preferably each spiral spring is a constant force spring.

Preferably each spiral spring member has one end thereof secured to the container and a spiraled portion that is cavity mounted in the force application member.

Preferably at least a portion of one or more of the walls or panels of the container is transparent or translucent to provide a viewing window for visual confirmation of a number of magazines in the compartment.

Preferably there is provided an environmental cover movable between a closed position sealed over the magazine ejection port and an open position revealing the magazine ejection port.

Preferably the environmental cover is externally mounted to move out of the closed position in a same direction in which the magazines are ejected through the ejection port.

Preferably there is provided a latch operable to secure the environmental cover in the closed position, and wherein the environmental cover is spring biased toward the open position.

Preferably there is provided an ejection assist mechanism mounted on the container and operable to convey the lowermost magazine further through the ejection port from the partially ejected state.

Preferably there is provided the ejection assist mechanism comprises a handle accessible outside the container for manual sliding along the bottom panel.

Preferably there is provided the ejection assist mechanism is configured to displace a conveying member thereof toward the ejection port along the bottom panel inside the compartment under drawing of the handle in an opposite direction away from the ejection port along the bottom panel outside the compartment.

Preferably there is provided the force application member is dimensioned to prevent automatic conveyance of the force application member through the ejection port by the magazine ejector.

Preferably the force application member being dimensioned to abut against the forward panel when conveyed toward the ejection port by the magazine ejector.

There may be provided an empty magazine insertion port in the container located at a distance from the bottom panel and on side of the force application member opposite the bottom panel, the empty magazine insertion port being sized for insertion of an empty one of the magazines back into the compartment for storage on the side of the force application member opposite the bottom panel.

There may be provided alignment guides on the container to guide the empty magazine into the insertion port.

Preferably the insertion port is located in one of the forward panel, rearward panel, front wall and rear wall, and the container comprises upper spring members at a top panel lying opposite the bottom panel to force the empty magazine toward the bottom panel under insertion of the empty magazine to the compartment through the insertion port.

Preferably an empty magazine support movably disposed between the force application member and the insertion port and biased toward the insertion port in a direction toward the top panel, a biasing force of the empty magazine support toward the top panel being less than an opposing spring force provided by the upper spring members, whereby the empty magazine support maintains an orientation of the empty magazine as it enters the insertion port and is displaceable against the biasing force to allow stacking of multiple empty magazines between the empty magazine support and the top panel.

According to a second aspect of the invention there is provided a multiple magazine self dispensing container that automatically dispenses partially ejected magazines for firearms using ammunition magazines, the multiple magazine self dispensing container comprising:

a multiple magazine self dispensing container having a front wall, a back wall opposite the front wall, a top panel, a bottom panel opposite the top panel, a forward panel, a rearward panel opposite the forward panel;

said container having a magazine ejection port between the forward panel and bottom panel the front wall and the back wall;

said container having a incline plane opposite the magazine ejection port that slopes down from the rearward panel to the bottom panel;

said container defining a firearm magazine compartment dimensioned and configured for containing a plurality of the magazines in a stacked side by side or parallel relationship;

said container having a constant force mechanism for urging the magazines stored within the container toward an automatic dispensing system with one or more constant force springs exerting force on a constant force member.

According to a third aspect of the invention there is provided a multiple magazine storage and dispensing container for storing and dispensing ammunition magazines for firearms, the multiple magazine storage and dispensing container comprising:

a container defining an inner compartment dimensioned for containing a stack of the magazines;

a full magazine port at or adjacent a first end of the container;

an empty magazine port at or adjacent a second end of the container opposite the first end thereof; and a force application member movably disposed within the compartment between the full magazine port and the empty magazine port, and biased toward the first end to urge a stack of full magazines stored within the container toward the first end for removal of the full magazines one at a time through the full magazine removal port;

whereby empty magazines are insertable into the compartment on the side of the force application opposite the stack of full magazines for storage of the empty magazines.

Preferably there is provided a port clearing mechanism operable to automatically convey each empty magazine toward the force application member upon insertion of the empty magazine through the empty magazine port, whereby the empty magazine port is left unobstructed by said magazine and ready for subsequent insertion of another empty magazine.

Preferably there is provided the port clearing mechanism comprises at least one spring strip having an end thereof attached to the second end of the container, and angling toward the first end of the container and away from the empty magazine port.

Preferably there is provided a support member movably disposed within the compartment between the empty magazine port and the force application member, the support member being biased toward empty magazine port by a spring force less than another spring force exerted in an opposing direction by the port clearing mechanism.

According to a fourth aspect of the invention there is provided a multiple magazine dispensing container for dispensing ammunition magazines for firearms, the multiple magazine dispensing container comprising:

a container defining an inner compartment dimensioned for containing a stack of the magazines;

a magazine removal port at or adjacent a first end of the container;

a force application member movably disposed within the compartment and biased toward the first end to urge a stack of full magazines stored within the container toward the first end for removal of the full magazines one at a time through the magazine removal port; and one or more covers operable to enclose the inner compartment in a water-tight manner, including a removal port cover movable between a closed position sealed over the magazine ejection port and an open position revealing the magazine removal port.

Preferably there are provided one or more spiral spring members that bias the force application member toward the first end of the container and that each run along a wall or panel of the container and transition from inside the compartment, where the spring member connects to the force application member, to outside the compartment through a spring opening situated in the respective one of the walls or panels at a distance from the bottom panel; and a respective spring opening cover arranged to seal over each spring opening.

According to a fifth aspect of the invention there is provided a multiple magazine dispensing container for dispensing ammunition magazines for firearms, the multiple magazine dispensing container comprising:

a container defining an inner compartment dimensioned for containing a stack of the magazines;

a magazine removal port at or adjacent a first end of the container;

a force application member movably disposed within the compartment; and one or more springs each installed in connection between the force application member and the container to bias the force application member toward the first end to urge a stack of full magazines stored within the container toward the first end for removal of the full magazines one at a time through the magazine removal port;

wherein the one or more springs are removable from the connection between the container and the force application to enable removal of the force application member from the container for cleaning or service.

Preferably each spring is disconnectable from both the force application member and the container.

Preferably each spring is a spiral spring member having a coil portion cavity mounted on one of the container or the force application member, and an uncoiled end connected to the other of the container or the force application member.

Preferably the coil portion of each spiral spring member is cavity mounted on the force application member, and the uncoiled end of the spiral spring is releasably connected to the container at an exterior thereof.

According to another aspect of the invention, there is provided a multiple magazine self dispensing container that automatically dispenses firearm magazines of a predetermined size, the multiple magazine self dispensing container comprising:

a container defining an inner compartment having, on respective sides thereof, a front wall, a back wall opposite the front wall, a forward panel, a rearward panel opposite the forward panel, and a bottom panel, the inner compartment being dimensioned for containing a stack of the magazines;

a magazine ejection port on the container located opposite the rearward panel between the forward panel and the bottom panel;

a force application member disposed within the compartment;

one or more constant force springs connected between the container and the force application member and biasing the force application member toward the bottom panel to urge the stack of magazines stored within the container toward the bottom panel with constant force, regardless of the number of magazines in the stack; and a planar ramp located inside the inner compartment of the container at a position opposite the magazine ejection port and sloping downward from the rearward panel to the bottom panel at a continuous linear slope, the planar ramp being operable to automatically convey a lowermost magazine of the stack nearest the bottom panel toward and partially through the magazine ejection port into a partially ejected state protruding from the container;

wherein a port height of the magazine ejection port, measured in a height direction of the container in which the bottom panel is spaced from an opposing top end of the inner compartment, is greater than a corresponding magazine height of the magazines and less than twice said magazine height, and a height dimension of the ramp measured in the height direction of the container is less than said port height and less than said magazine height, whereby the firearm magazines of predetermined size are brought into contact with the ramp, and partially ejected through the port, only one at a time.

Other features and advantages will be apparent to those who carefully read the detailed description of the preferred embodiments below.

BRIEF DESCRIPTION OF THE DRAWINGS

In the accompanying drawings, which illustrate exemplary embodiments of the present invention:

FIG. 3 is a top down view of the first embodiment with the top panel of the container removed showing the internal mechanism of a fully stocked container.

FIG. 4 is a back view of the first embodiment with the back wall of the container removed showing the internal mechanism of a fully stocked container.

FIG. 5 is a forward side view of the first embodiment container with the forward panel and angled leading edge of the constant force plate removed showing the internal mechanism of a fully stocked container.

DETAILED DESCRIPTION

Figure 1:
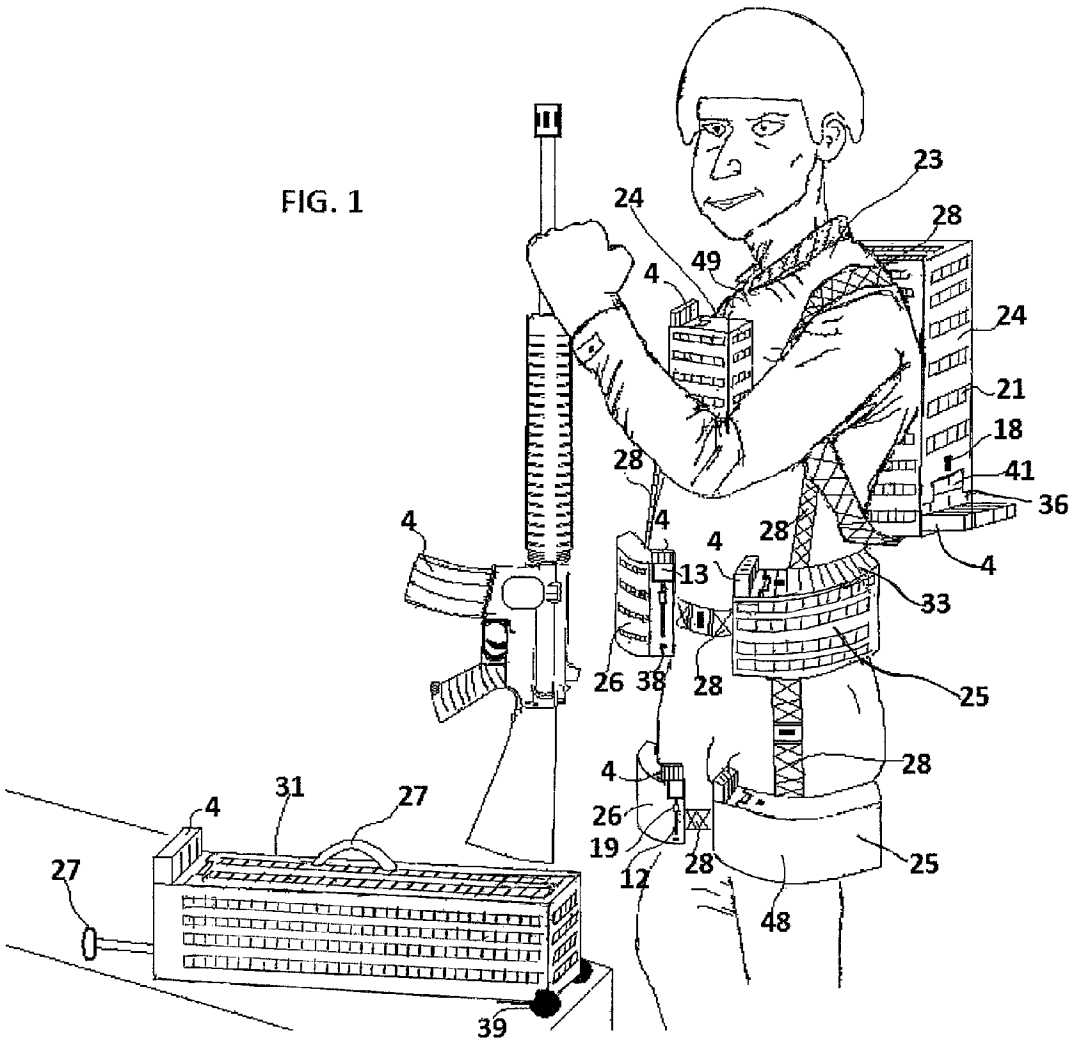
FIG. 1 is an environmental perspective view showing four embodiments of a magazine dispensing container of the present invention.

The multiple magazine self dispensing container is constructed from a suitable rigid substance in the form of a container with a rectangular inner compartment. The height is the internal distance from the top panel 14 to the opposing bottom panel 15. The length is the internal distance from the forward panel 9 to the opposing rearward panel 10. The width is the internal distance from the front wall 7 to the opposing back wall 8. The internal width and length dimensions of the container 35 are only slightly larger then the width W and length L of the magazines it carries, and the height of the container interior determines the number of magazines stored within it. In this description, the length L of the magazine is its greatest of its three dimensions measured in orthogonal directions, the width W representing the second largest dimension, and the height representing its third largest (or smallest) dimension. The magazine's are stacked together face to face at their largest faces, which mark the length and width of the magazines.

Figure 8:
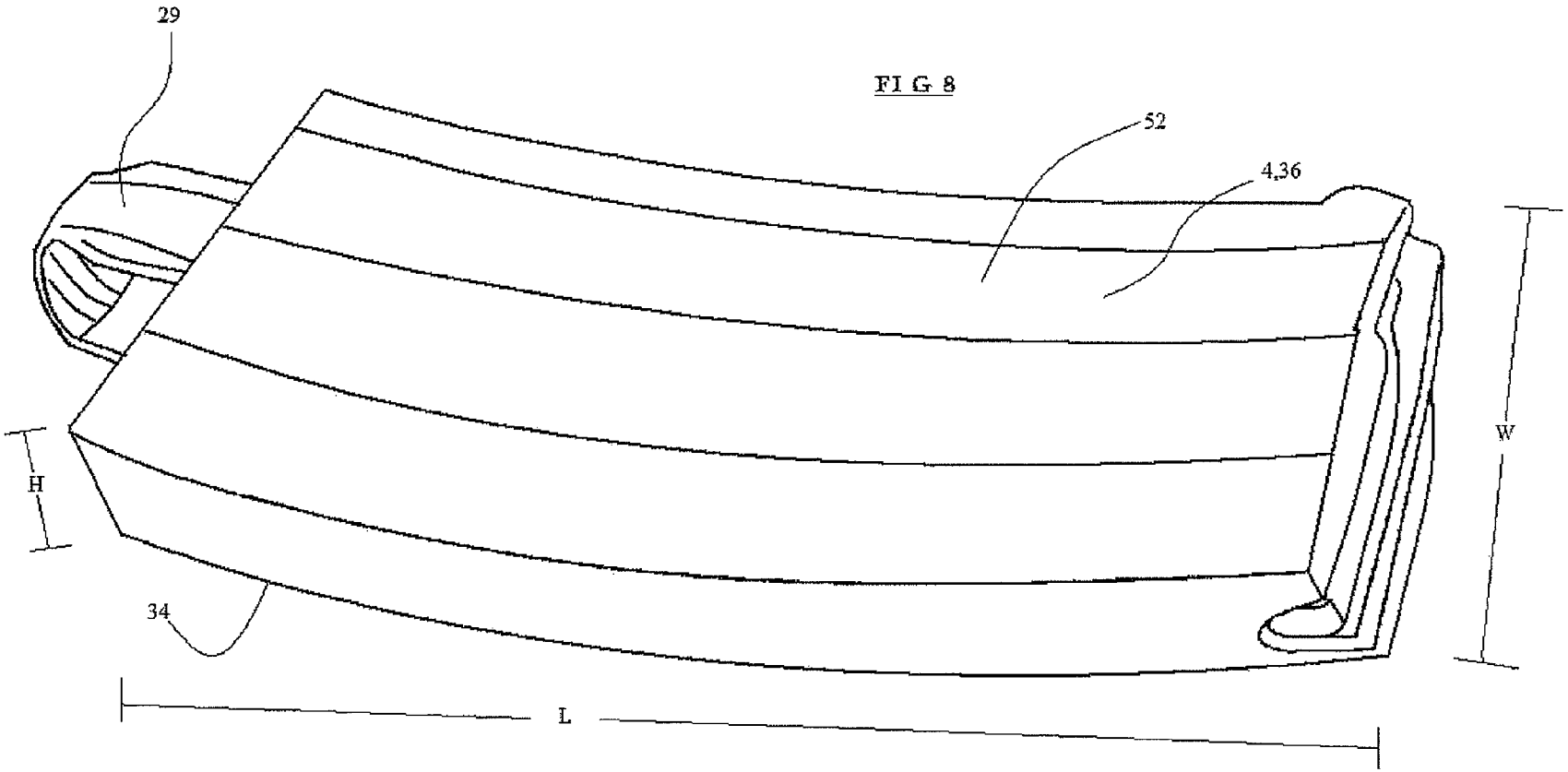
FIG. 8 is a back, top and right perspective view of a magazine detailing dimensions of a typical magazine.

The container's length may be modified to accommodate the extra length of magazine extraction extensions 29, as shown in FIG. 8, which may assist the operator in retrieving a magazine from the container. The container may be constructed of translucent or transparent materials 33 to allow the operator 23 to take stock of the magazines remaining in the container 35. The use of an inconspicuous or unobtrusive coating 48 on the walls and panels allows for greater stealth and matching of the operator's uniform.

The magazine ejection port 17 has a height of less than two magazines stacked within the container 35, but more than a single magazine height H, thus allowing easy restocking of the container 35 through the ejection port from which the magazines are also dispensed, but preventing a double feed of magazines to the operator 23. The magazine ejection port 17 can also be equipped with a restocking slit 41 (FIG. 1) that allows the operator to insert one or more fingers into the forward panel 9 just above the magazine ejection port 17 to hold up the magazine 36 in the stack while the operator inserts another magazine 4 into the magazine ejection port 17, sliding it up the incline plane 16. The magazines are stacked in a parallel relationship with each other in the container 35 with relatively wide front side 52 of each magazine facing and abutting the relatively wide rear side 34 of the next magazine. The rear side 34 is the opposite side of the front side 52. The magazines stacked in the container 35 are said to be parallel with each other because they form parallel lines with each other along the cross section lines 30 of FIGS. 4 and 5.

The automatic dispensing system described below causes the magazine 4 to be partially ejected from the container automatically. The downward force of the constant force plate 5 onto the magazines that are stacked within the container 35 pushes the magazines towards each other, and ultimately against the incline plane 16 that forms an obtuse angle with the bottom panel 15 of the container 35 at a location opposite to the magazine ejection port 17. The magazine 36 slides down the incline plane 16 when there is a open space in magazine 4 position and rolls out on the conveyor roller 47 (FIGS. 4 & 5) through the magazine ejection port 17 to a predetermined distance determined by the length 37 of the incline plane 16, thereby allowing the operator 23 to grasp the now partially ejected magazine 4 and, with an outward pulling force 40, remove the magazine 4. This process of a stored magazine 36 stacked inside the container becoming dispensed magazine 4 ready for use outside the container is repeated as needed, until the container 35 is depleted of magazines.

The constant force plate 5 is pulled down by constant force springs 1 attached to the spring support rod 3 located on top of the constant force plate 5, where the coiled portion of each spring 1 closes around the rod 3 for rotatably carrying thereon. The other end of each spring can be attached to the bottom panel 15, or attached to the forward panel 9, reward panel 10, front wall 7, or back wall 8 of the container 35 at a location nearer to the bottom panel 15 than the top panel 14. In the example of FIG. 4, the bottom panel mounting point 32 is used for the connection of the uncoiled end of each spring 1. The constant force spring 1 coils and uncoils on the spring support rod 3 that passes through the center hole of the constant force spring 1. Each spring is kept in proper location on the spring support rod 3 by using spring guides 2 mounted on the rod 3 and a constant force spring groove 42 formed in the interior face of the respective front or back wall 7, 8. The illustrated spring guides 2 are thin circular washers with a diameter only slightly larger then the constant force springs 1 diameter and are permanently mounted onto the spring support rod 3, with one guide 2 on each side of the constant force spring 1.

Figure 2:
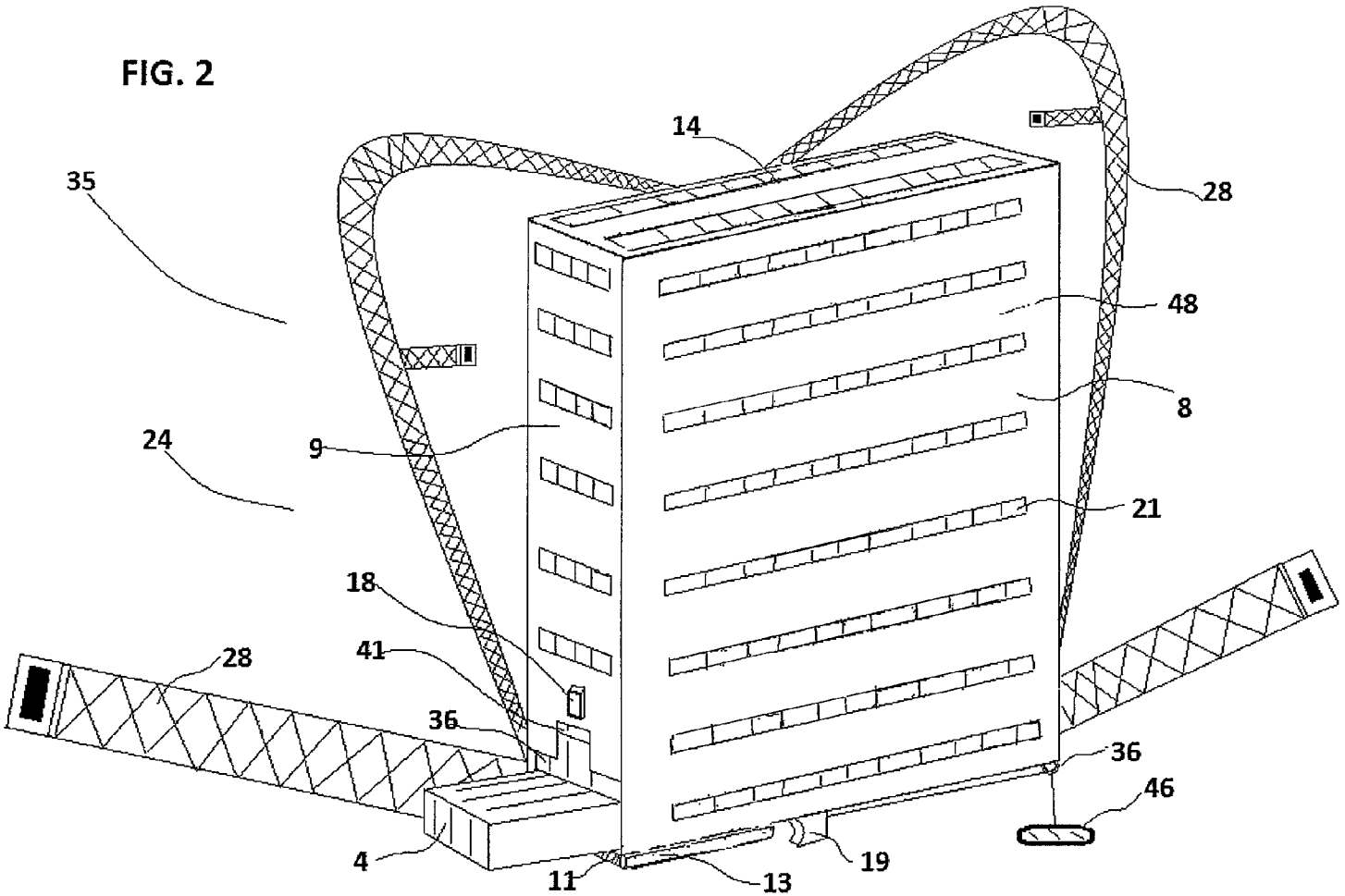
FIG. 2 is a back, top and left perspective view of the first embodiment, detailing features with an example of a torso and shoulder harness assembly attached to the front wall of the container.

The container 35 can use attachments 21 that connect the container's walls or panels to the operator's 23 garment 49, or can be worn using a torso, leg or shoulder harness assembly 28 of the operator's choosing that can be attached directly to the container 35. The present invention can be connected to a garment 49 by using attachments 21 that can be located on any or all the walls and panels of the container 35, as shown in FIG. 2. These attachments 21 may come in any shape or design, for example as desired by the operator 23, however woven webbing for modular attachment is used as an example in the drawings. As an alternative to attachment of straps or harness components to the container, the container may be carried in a separate bag having an interior generally conforming to the outer shape of the container, and having an opening suitably positioned to communicate with the ejection port of the container. The bag may employ a combination of both shoulder straps and a waistband, thus providing a backpack like configuration that removes some of the load from the shoulder area by carrying some weight at the waist, thereby improving arm and upper body mobility. A similar shoulder and waist borne configuration may be directly attached to the container instead of to a separate bag.

Figure 7:
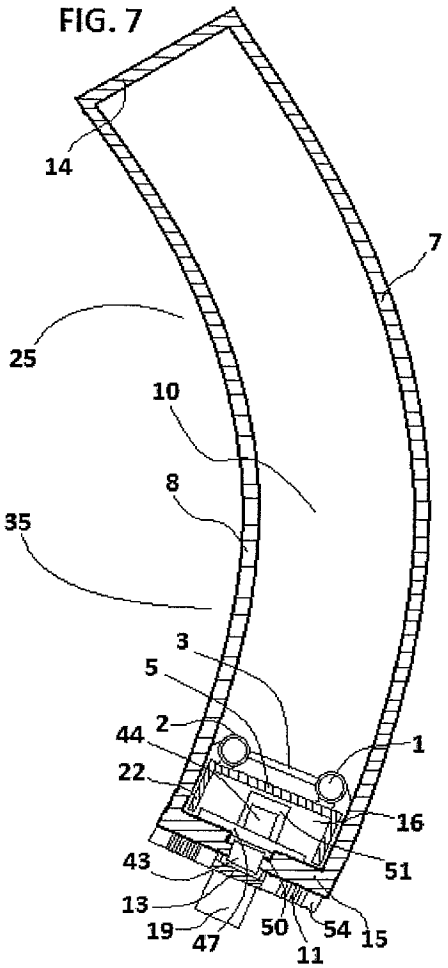
FIG. 7 shows a left hand curve of the third embodiment container and is a forward end view with the forward panel showing the internal mechanism of a depleted container.
Figure 6:
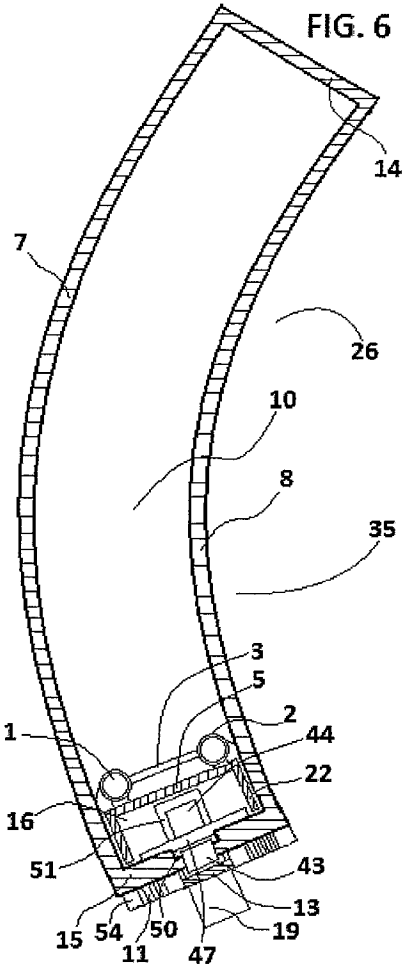
FIG. 6 shows a right hand curve of the second embodiment container and is a forward end view with the forward panel removed to show the internal mechanism of a depleted container.

The first embodiment 24, second embodiment 26, third embodiment 25 and fourth embodiment 31 internal and external mechanisms are the same. The first embodiment 24 displayed in FIG. 1 through FIG. 5 is straight and designed, but not limited, to be worn on the operators 23 back and chest, as seen in FIG. 1. The second 26 and third 25 embodiments as seen in FIG. 1, FIG. 6 and FIG. 7 are mirror images of each other and have a curvature adapted so that the operator 23 can wear the container 35 on their left (FIG. 7) or right (FIG. 6) side comfortably. It will be appreciated that for consistency, the panels and walls of the curved embodiments are labeled according to the same top, bottom, front, back, forward, rearward direction conventions used for the other embodiments, but that these directions do not necessarily denote a particular orientation in which the container might be used. For example, with reference to FIG. 1, the curved containers worn about the side of the torso or waist, or about the user's thigh, are worn in an orientation where the 'top panel' faces behind the wearer and the 'forward panel' faces upward. This way the magazines are ejected upward for convenient grasping by the user. In other words, 'forward' is being used to describe the direction in which each magazine moves during its ejection from the container.

The fourth embodiment 31, seen in FIG. 1, is identical to the first embodiment 24 except that it is designed not to been worn by the operator 23. Instead it is to be carried like a brief case or transported like luggage on wheels 39 using the handles 27, or can be mounted to a vehicle or permanent structure (e.g. a guard house wall) and dispenses the necessary quantity of magazines to the operator 23 but without the operator 23 having to carry any magazines on their body.

The magazine ejection port 17 is sealed from the elements with an environmental cover 13 that uses a rubber seal and has dimensions large enough to cover the magazine ejection port 17, and restocking slit 41 if included. To retrieve a magazine 4 the operator 23 opens the environmental cover 13 by sliding the spring-loaded magazine ejection port access button 18 away from the environmental cover 13. The environmental cover 13 pivots away from the magazine ejection port 17 using two cylindrical torsion springs 11, with a space between them for the metal strip 43 detailed below. The cylindrical torsion springs 11 are held in place using the torsion spring dowels 53 that are inserted into the center of the cylindrical torsion springs 11. The torsion spring dowels 53 are attached to the bottom panel 15 using torsion spring brackets 54 located on each end of the torsion spring dowels 53. Under the force of the torsion springs, the environmental cover 13 pivots until it comes to a stop on or adjacent the exterior bottom side of on the bottom panel 15, where it stays when the dispenser is in use. With the environmental cover 13 opened, the first magazine 4 partially ejects automatically. Aside from being accessible to the operator wearing or carrying the container, magazines can also be removed from the container 35 by other individuals in close proximity without any action taken by the operator 23, thereby allowing the operator to focus on threats instead of their team member who requires a magazine.

The constant force plate 5 is equipped with stops 22, one on each side next to the front 7 and back 8 walls, and are shorter than the height of a magazine. The stops 22 are designed to prevent the constant force plate 5 from contact with the bottom panel 15. The constant force plate leading edge 6 closest to the magazine ejection port 17 is angled upwards towards the top panel 14. The stops 22 and constant force plate leading edge 6 allow for easer restocking of the first magazine 4 into the container 35.

If the operator 23 is unable to fully grasp the partially ejected magazine 4 because of injury or wearing gloves or mittens, for example, the operator 23 can use the forward assist handle 19 to eject the magazine 4 completely from the container 35, or into a further partially ejected state until the operator 23 is able to fully grasp it. The forward assist handle 19 is center-mounted underneath the bottom panel 15 and follows a forward assist track 12 going in the direction from the forward panel 9 to rearward panel 10. The forward assist handle 19 is attached to a thin metal strip 43 or equivalent that runs along the bottom panel 15 towards the magazine ejecting port 17 and curves around the leading edge of the magazine ejecting port 17 into the forward assist groove 50 on the inside of the bottom panel, and continues under the conveyor roller 47 and is then attached the forward assist latch 44. The forward assist latch 44 and forward assist constant force spring 45 are attached using the same method as for the constant force plate 5, and both normally reside under the incline plane 16 so they do not interfere with the normal operation of the container 35. When the forward assist handle 19 is pulled toward the rearward panel, force is exerted on the forward assist latch 44 in an outward direction toward the ejection port 17 by the metal strip 43. The forward assist latch 44 and forward assist constant force spring 45 pass through forward slit 51 in the incline plane 16, and the latch 44 forces a magazine 4 further outward through the magazine ejection port 17 until it is completely ejected or the operator 23 is able to grasp it. The forward assist latch 44 is then pulled back to its normal position under the incline plane 16 by the forward assist constant force spring 45. The forward assist handle 19 can also be operated by a remote handle. The remote handle is attached to a cable that that passes through the remote guide 38, which is a ring located at the intersection of the bottom panel 15 and the rearward panel 10 on the outside of the container 35 and then attached to the forward assist handle 19. The remote handle can be placed anywhere on the operators 23 body by extending the length of the cable between the forward assist handle 19 and remote handle.

FIGS. 9 through 15 illustrated a fifth embodiment container 60 that has the same flat configuration as the first embodiment, but differs in the details of some of the mechanisms employed in its function.

Firstly, the constant force plate 5 and attached spring support rods 3, spring guides 2 and stops 22 are replaced with a constant force block 60, which like the constant force plate of the preceding embodiments acts to apply the force from constant force spiral springs against the uppermost magazine in the container to urge that magazine, and any others on which it is stacked, toward the bottom panel 15 of the container. The constant force block 60 has a generally rectangular outer shape, substantially filling the length and width of the rectangular inner compartment of the container. The block 60 features three cavities opening into the block, one forward end cavity 62 at the end of the block 60 facing the forward panel 9, one front side cavity 64 at the side of the block facing the front side wall 7, and one rear side cavity 66 at the side of the block facing the back side wall 8. The two side cavities 64, 66 are located near the end of the block 60 opposite the forward end cavity 62, and align with one another along the length of the block. Each cavity features an arcuately curved wall 68 that faces outwardly from the block. The forward end cavity 62 houses the spirally coiled portion of a single constant force spring 20, while each side cavity 64, 66 houses the spirally coiled portions of two side-by-side constant force springs 20. The radius of curvature of the arcuate wall 68 of each cavity exceeds the fully-coiled radius of the constant force springs so that the coiled portion of the spring is rotatably seated against the accurate wall. From its cavity mounted coiled portion, each spring 20 extends downward along the inside of the respective wall or panel of the housing. The fifth embodiment lacks the spring grooves 42 of the first embodiment, the springs instead running down the fully planar interior face of the respective wall or panel.

Figure 11:
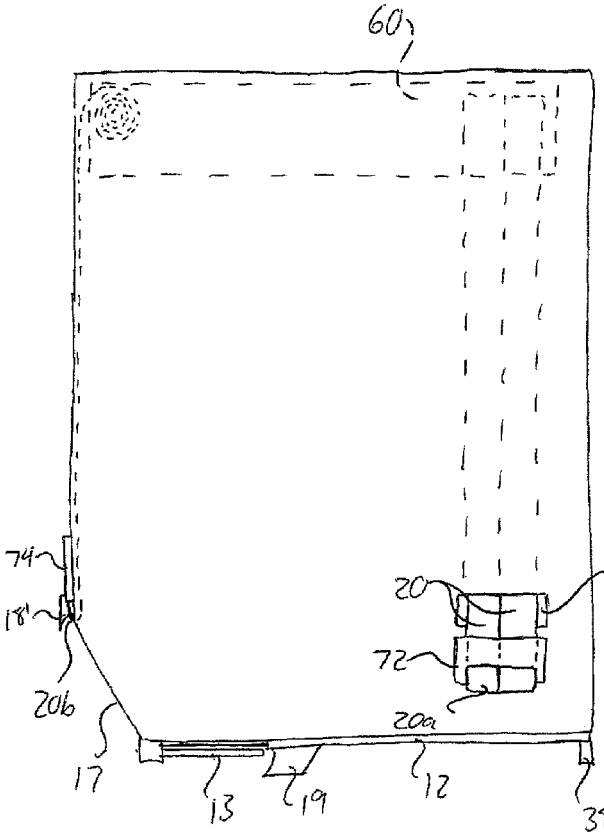
FIG. 11 is a back view of the fifth embodiment container in a fully stocked condition.
Figure 12:
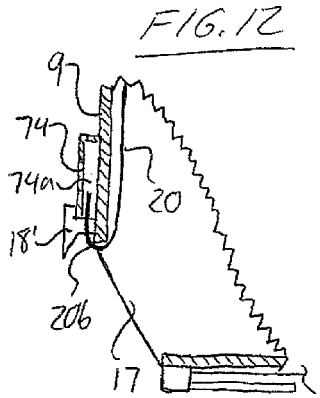
FIG. 12 is a partial cross-sectional view of the fifth embodiment container as taken along line A-A of FIG. 9, with the magazine of FIG. 9 omitted.
Figure 13:
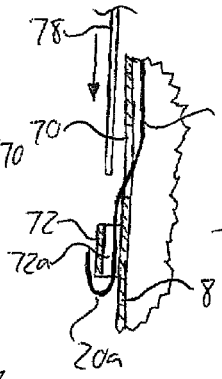
FIG. 13 is a partial cross-sectional view of the fifth embodiment container as taken along line B-B of FIG. 10.

FIG. 11 uses broken lines to illustrate the fully raised position of the block 60, as would occur when the container is loaded with a full stack of magazines, which places the block 60 closely adjacent the top panel of the container. To avoid damage to the springs or interference with insertion of a full magazine into the compartment through the ejection port 17 when loading the container, the springs 20 do not have their uncoiled ends attached to the bottom panel 15 inside the compartment like in the first embodiment. With reference to FIGS. 11 to 13, each spring 20 instead transitions to an exterior of the container, where the uncoiled end of the spring is secured to the respective container wall or panel. The front and rear walls each feature a respective spring opening 70, the bottom of which is located at a distance upward from the bottom panel 15, preferably at a height equal to or greater than that of two magazines. The spring opening 70 of each wall aligns with the springs of the respective side cavity of the constant force block 60 in the length direction of the container, and the opening 70 is large enough in this direction to accommodate side-by-side passage of the two springs through it.

Beneath the spring opening 70 of each wall, a hollow sleeve 72 is formed on the exterior of the wall to form an enclosed, open-ended channel with an upper end thereof facing upwardly toward the top panel of the container at a short distance below the spring opening 70, and a lower end of the channel facing downwardly toward the bottom panel 15 of the container. The channel has a slit-like cross section large enough to accommodate passage of the two side-by-side springs through it in a close-fitting manner. The two respective springs thus extend downward inside the container from their coiled portions rotatably seated in the respective cavity of the constant force block 60, then transition to the exterior of the container wall at the spring opening 70, and then continue downward through the sleeve's internal channel 72*a* on the exterior of the wall. Here, the end of the spring is bent to curve back upward over the exterior side of the sleeve 72, and this bent lower end 20*a* of the spring thus hooks the spring to the lower end of the sleeve 70 in order to connect the spring to the respective wall of the container on the exterior side thereof. The spring's tendency to coil itself up thus acts to bias the block 60 downward toward the bottom panel 15 of the container, with the block thus exerting the spring force against any magazines disposed beneath the block 60.

Figure 9:
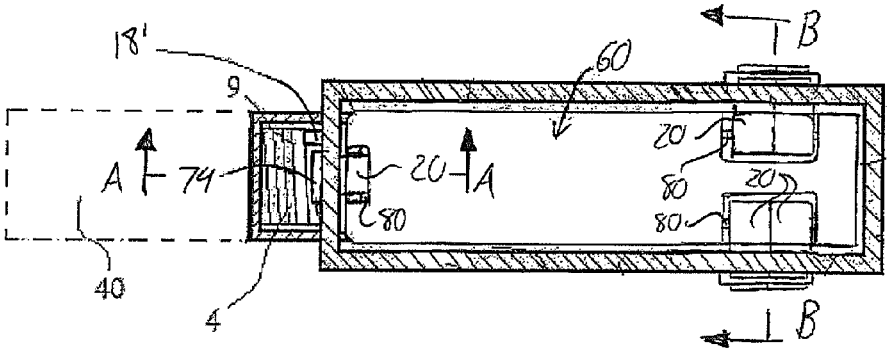
FIG. 9 is a top down view with a top panel of the container removed, like FIG. 3, but of a fifth embodiment container.

The spring in the forward end cavity 62 of the block 60 is similarly connected to the exterior of the container at a location nearer the bottom of the container than the top in order to contribute to the spring biasing of the block 60 downward inside the compartment. With reference to FIGS. 11 and 12, the spring extends downward inside the container from its coiled portion rotatably seated in the respective cavity of the constant force block 60, and then transitions to the exterior of the container wall at the top end of the magazine ejection port 17 for connection to the exterior of the forward panel 9. A downward opening pocket 74 is fixed to the exterior of the forward panel 9 a short distance above the top end of the ejection port 17, and the spring bends through 180-degrees at its passage through the ejection port to turn upward and insert its free end into the interior of the pocket 74*a*. The bent portion 20*b* of this spring thus hooks the spring to the forward panel in a manner similar to the hooking of the other springs to the front and back walls of the container. Although the forward end spring is shown as inserted into a pocket-like channel that is closed at one end, the pocket on the forward panel may be replaced with sleeve that is open at both ends, like those used on the front and back walls. With reference to FIG. 9, the ejection port access button or slider 18' for latching the environmental cover 13 in a closed position over the ejection port 17 is not centrally located on the forward wall in this embodiment, but rather is offset from the central longitudinal plane of the container so as to run up and down beside the pocket 74 and leave room for the hooked connection of the forward end spring to the forward panel of the container.

Figure 14:
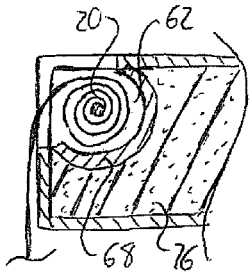
FIG. 14 is a cross-sectional view of a constant force block of the fifth embodiment container as taken along line A-A of FIG. 9.
Figure 15:
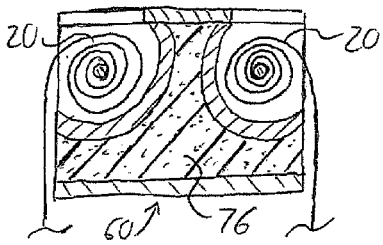
FIG. 15 is a cross-sectional view of the constant force block of the fifth embodiment container as taken along line B-B of FIG. 9.

The use of springs at both the forward end of the block 60 and on the front and back sides of the block near the rearward end of the block acts similar to the first embodiment configuration of springs near the front and rear end of each side of the constant force plate to provide well balanced pulling forces that maintain a consistent orientation of the block or plate, which in turn applies these forces to the magazines, thus maintaining proper alignment of the magazines in the container to prevent jamming. With reference to FIGS. 14 and 15, prototypes of the fifth embodiment employ a block 60 of a hollow plastic body filled with rigid spray foam 76 to provide a high rigidity to weight ratio, but it will be appreciated that other structures may be employed.

Figure 10:
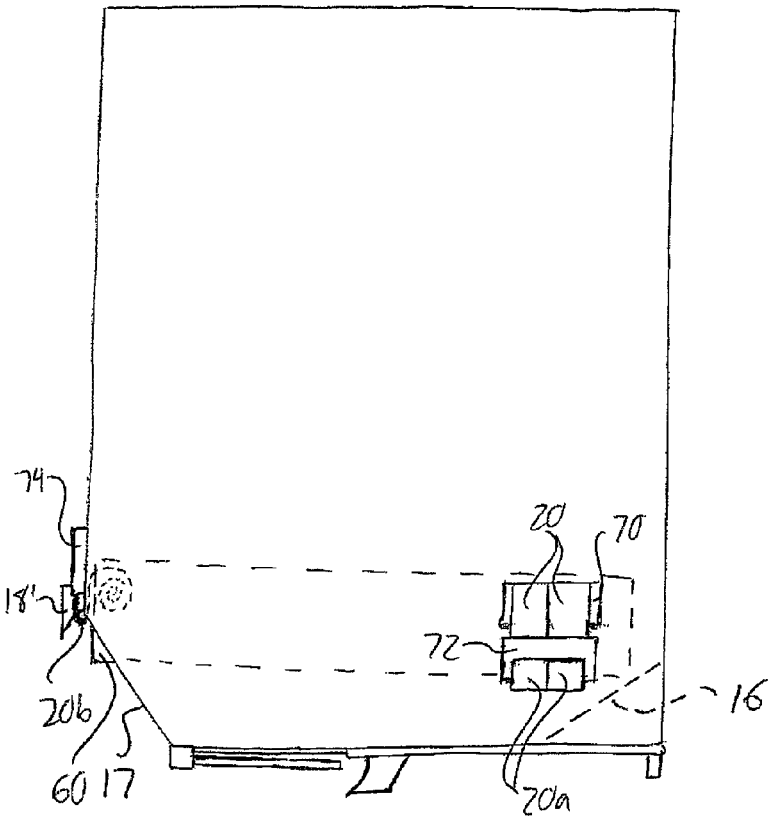
FIG. 10 is a back view of the fifth embodiment container in a depleted condition.

FIG. 10 illustrates the fifth embodiment with the block 60 in a lowered state abutting against the ramp formed at the inclined plane 16, as occurs when the container has been depleted by removal of all magazines (one at a time) through the ejection port. As shown, the dimensions of the block relative to those of the ejection port 17 and inclined ramp 16 are such that the forward end of the block 60 will abut against the forward panel 9 under the block's spring-biased engagement with the ramp 16. That is, the height and length of the block 60 are such that when the block slides far enough down the ramp 16 to reach the plane of the forward panel 9, the top of the block 60 remains above the ejection port 17. The ramp, block and ejection port are thus configured to prevent automatic ejection of the block 60. Similar ejection prevention for the block is provided by the hooked engagement of the side springs of the block to the front and back walls of the container, as the enclosure of the springs in the external sleeves 72 on these walls prevents sliding of the block 60 toward the ejection port 17.

However, the springs and block can be fully removed from the container, for example for cleaning or service of any or all components. With the container emptied of all magazines, and the block 60 thus abutted against the ramp as shown in FIG. 10, a thin, narrow spring removal tool 78 can be forced downward through each of the sleeves 72 on the front and back walls of the containers on the side of the spring opposite this wall, as shown in FIG. 13. This forces the bent lower ends 20*a* of the springs downward out of their hooked engagement about the lower end of the sleeve 72, at which point the bent end 20*a* can be manually pinched together into a flat configuration and inserted into the lower end of the sleeve's channel 72*a*, at which the point this lower end of the spring can thus be passed upwardly through the sleeve for full removal of the spring therefrom, either by pulling upward on the spring from above the sleeve, or using the spring removable tool 78 for pushing the spring end upward from below. The spring's self-recoiling action will draw the free end of the spring into the container through the respective spring opening 70. A removal tool may be included with the container, for example a ruler-shaped rectangular strip of suitably strong metal or other material, or a knife or other non-specialized tool may be employed. Where a tool is included, the container may incorporate a means to releasably carry the tool on the container.

Figure 16:
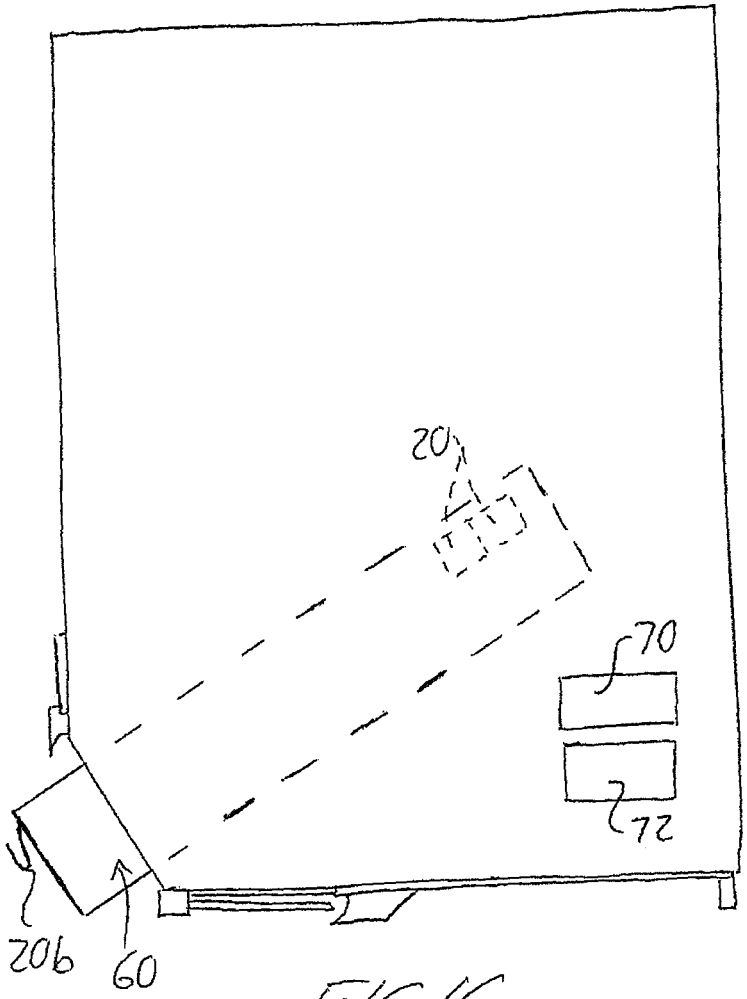
FIG. 16 is a back view of the fifth embodiment during removal of the constant force block for disassembly and cleaning or service of the container.

The forward end of the block 60 can now be lowered at the ejection port 17, as the opposing rearward end of the block is no longer held downward by engagement of springs with the front and rear walls of the container. The lowering of the block's forward end withdraws the forward end spring out its hooked engagement around the lower edge of the forward panel 9 of the container above the ejection port 17. The height of the block 60 is less than the distance from the bottom panel to the forward panel along the oblique plane of the ejection port 17, and so with the block tilted in this manner, it can be withdrawn through the ejection port 17, as illustrated in FIG. 16. The springs cavity mounted on the block are thus also removed from the container with the block. To prevent potential loss of the springs when the unit is disassembled for cleaning or service, especially in the field, removable locking pins may be engaged through the central opening of each spring along the axis around which the spring is coiled, thus forming a shaft 80 on which the spring is rotatable in the respective cavity of the block. As shown in FIG. 9, the illustrated block 60 thus may employ three such pins, for example detent pins, one supporting the sole spring at the forward end of the block, and one at each of the front and back sides of the block to support the two springs in the respective side cavity.

Figure 17:
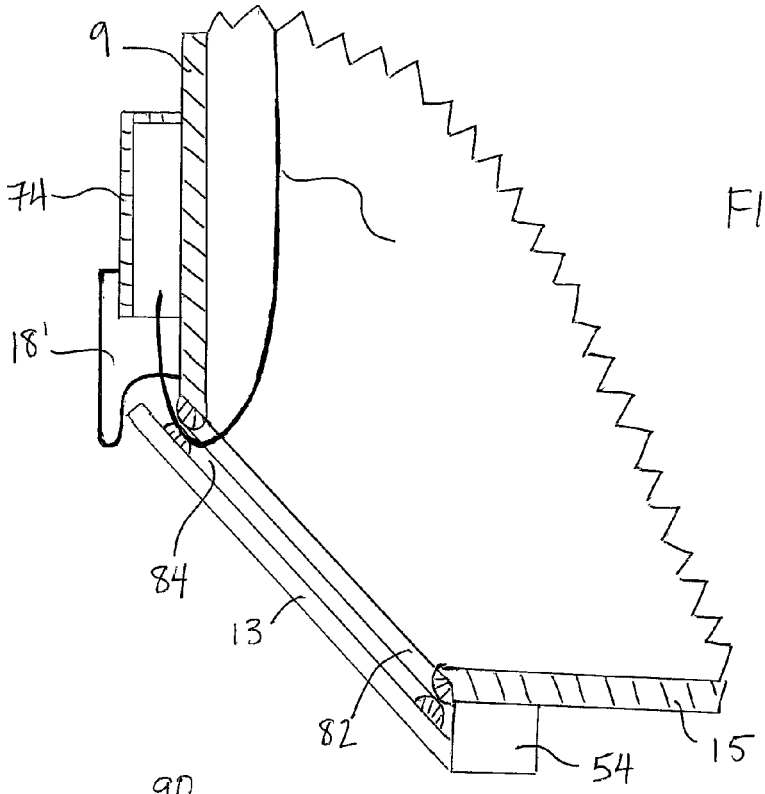
FIG. 17 is a closeup view of the fifth embodiment container, similar to FIG. 12, but showing an ejection port cover in a closed position with waterproofing seals engaged together between the cover and the container.

The container of the fifth embodiment is made waterproof when the ejection port 17 is closed off by the environmental cover 13. With reference to FIG. 17, a perimeter seal 82 closes around all sides of the ejection port on the container at the edges of the front and back walls and forward and bottom panels, and a corresponding perimeter seal 84 follows a same path around the perimeter of the environmental cover 13. The seals compress directly against one another around most of the ejection port when the pivotal cover 13 is latched in the closed position over the ejection port by the port access slider 18', except at where the bent lower end 20*b* of the respective spring hooks around the top edge of the ejection port 17. Here the seals 82, 84 each compress against the spring from opposite sides thereof to complete the sealed closure of the ejection port 17 around the perimeter thereof. The cover is openable by movement of the slider 18 upward against the spring force that biases it toward its lowered position, in which is hooks over the top end of the closed cover 13 to keep the same in place in the closed position. The cover automatically opens under the momentary upward lifting of the slider 18 due to the spring force that biases the cover into its open position under the bottom panel.

Figure 18:
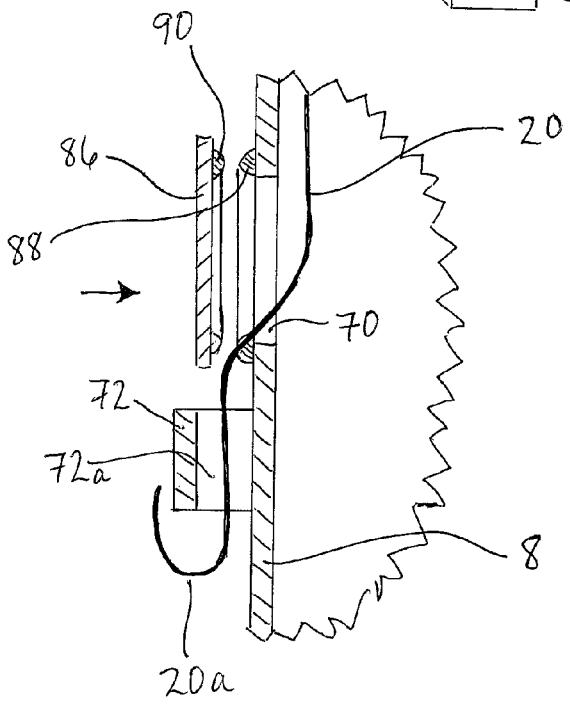
FIG. 18 is a closeup view of the fifth embodiment container, similar to FIG. 13, but illustrating installation of a waterproof cover over a spring-accommodating opening in the container.

Similarly, with reference to FIG. 18, a spring opening cover 86 may be included for each spring opening 70 of the container. This cover may likewise employ matching perimeter seals 88, 90 that close around the spring opening 70 and the cover 86 to seal directly against one another around most of the opening, and against opposite sides of the springs that pass through this opening to complete the fluid-tight closure of the opening 70. The cover may be selectively attachable and detachable to the container wall to close the spring opening during use of the container, and allow revealing of the spring opening for removal of the springs during disassembly. However, to prevent loss of components, the cover may instead be permanently attached to the cover and movable between open and closed positions. For example, the spring opening cover may employ a spring loaded, pivotal hinge connection like the ejection port cover 13, but spring biased into a closed position instead of an open position. A latching mechanism may be incorporated to temporarily secure the spring opening cover in an open position to ease the disassembly process by not having to manually hold the cover open during withdrawal of the springs from the sleeves and retracting of the released spring ends into the container interior. With seals used at all openings of the container, the container is effectively water tight when the ejection port is closed between uses of the container for magazine dispensing. Even when the ejection port is open for dispensing of magazines, the sealed closure of the spring openings still acts to minimize exposure of the container and its contents to the elements.

As an alternative to removal of the block 60 and springs 20 through the ejection port 17 for cleaning or service of the unit, the top panel of the container may be removably mounted, or movably mounted, for example by a hinge, for movement between open and closed positions revealing and closing off the respective end of the container. In such cases, once all the springs have been fully withdrawn into the container's inner compartment through the ejection port and spring openings, the container can be inverted with the top panel opened or removed to dump the block 60, and accompanying springs out of the container. Again, the springs may be releasably secured to the block by pins or other means to minimize the potential for loss of the springs, while still allowing removal of the springs for cleaning or replacement. Where the springs are not secured in place, but rather loosely seated in the curve cavities or recesses of the block 60, then removal of the block by inverting the container preferably includes placing one's hand over the open end of the container to catch the block and springs, and then inverting the block to prevent falling of the springs from the cavities of the block 60.

While constant force springs are preferable in order to provide consistent resistance to the withdrawal of the partially ejected lowermost magazine in the stack, other spring types could alternatively be employed, including use of compression-type coil springs disposed between the block and the top panel of the container to urge the block, and any magazines thereunder, toward the opposing bottom panel of the container for the self-ejecting action on the lowermost magazine at the incline plane of the ramp. Smooth consistent ejection without jamming, and good reloading performance and has been found for embodiments in which the ramp height from the bottom panel in a direction perpendicular thereto is slightly less than the height of a single magazine, and the port height in the same direction is calculated as the ramp height plus the single magazine height.

The container is preferably dimensioned for close fit to the magazine size in order to minimize rattling of the magazines within the container and resulting noise. The inner surfaces of the walls and panelized may be rubberized or otherwise provided with resiliency to further dampen noise caused by moving contact between the magazines and the walls. To better secure the uncoiled end of the spring that connects to the forward panel, a hole may be provided in the end portion of the spring for selective alignment with a corresponding hole in the pocket 74 for receipt of a locking pin, such as a detent pin, through the aligned holes to secure the spring to the pocket on the forward panel. Prototypes of the fifth embodiment have employed fiberglass walls, panels, pockets and sleeves. Materials employed for body armor may be employed in construction of the container to avoid or minimize the need to wear separate armor on an area of the body where the container is to be worn or carried. For example, containers of the present invention may employ Kevlar construction or components.

Figure 19:
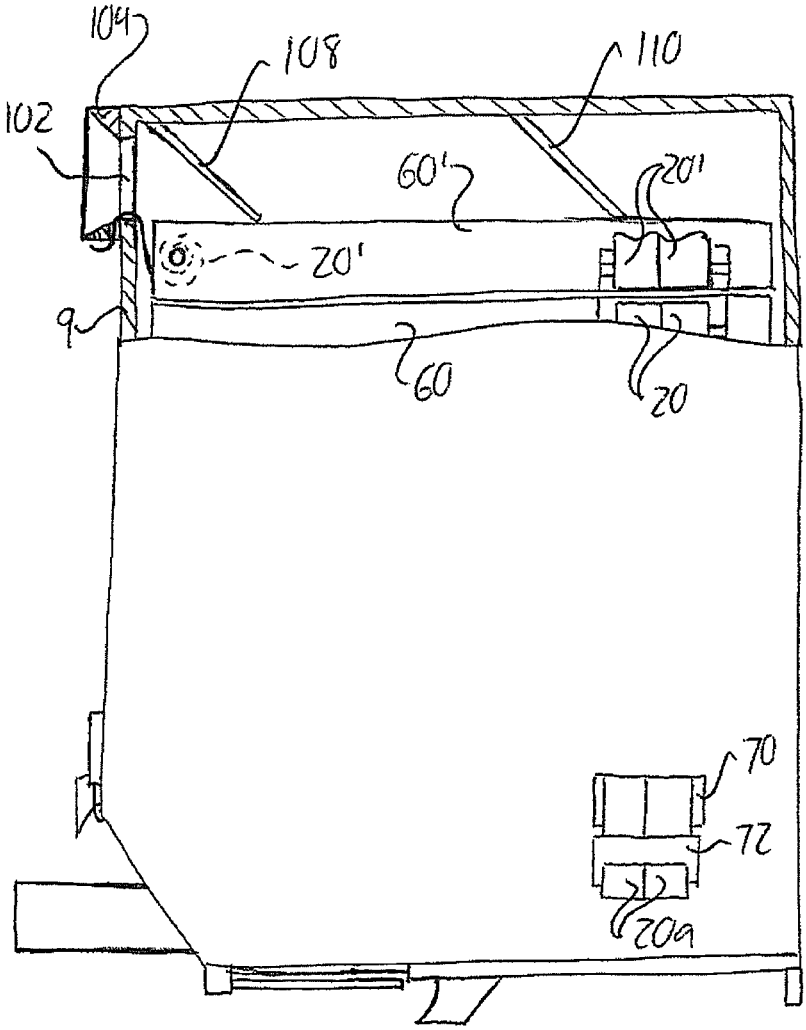
FIG. 19 is a back view of a sixth embodiment container with the back wall thereof partially cut away to show a system for allowing insertion of an empty magazine back into the container for storage after use, so that the used magazine can be recycled.
Figure 20:
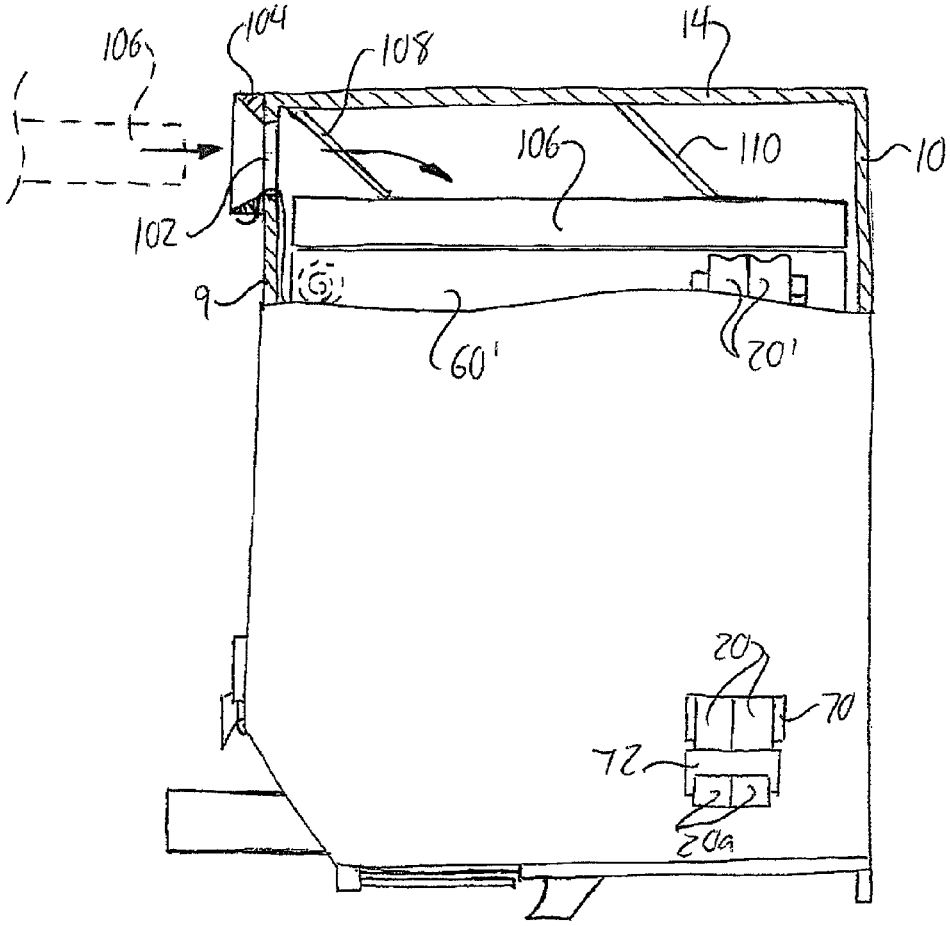
FIG. 20 is a back view of the sixth embodiment container with the back wall again partially cut away, illustrating insertion of a used magazine and storage of the same within the container.

FIGS. 19 to 20 illustrate a sixth embodiment container 100, which has all the same features of the fifth embodiment, but adds an insertion port 102 in the forward panel 9 at the top end thereof, just beneath the top panel 14. The insertion port 102 has a height that slightly exceeds the height of a single magazine to allow insertion of an empty magazine back into the container after use, so that the used magazines can be stored for later refilling and reuse. In each of the forgoing embodiments, each time a full magazine is removed from the container, a space for accommodating insertion of an empty magazine is automatically created. The sixth embodiment makes use of this space to allow the user to conveniently carry their depleted magazines.

An insertion guide 104 is mounted on the exterior of the forward panel 9, and features four sides that close around the rectangular insertion port 102. Each side of the insertion guide 104 is of a tapered configuration that narrows in a direction moving away from the insertion port 102. The wider end of each side of the insertion guide lies flush with the respective edge of the insertion port 102. The insertion guide 104 thus enlarges the target area that a user must direct the end of the empty magazine 106 toward in order to successfully reinsert the magazine into the container, as the tapered interior of the insertion guide will automatically direct the inserted end of the magazine through the insertion port 102 under continued pushing of the magazine through the guide.

Within the inner compartment of the container, two spring strips 108, 110 are cantilevered to the top panel 14 to depend obliquely downward therefrom in a direction sloping away from the forward panel 9 toward the opposing rearward panel 10. Each spring strips lies nearer a respective one of the forward and rearward panels than the other spring strip. In its normal state, each spring strip 108, 110 positions its lower end at or slightly below the elevation of the bottom edge of the insertion port 102. With reference to FIG. 20, as the empty magazine 106 enters the container through the insertion port 102, it abuts the first spring 108 and deflects the same upwardly toward the top panel 14, eventually reaching the second spring 110 and likewise deflective it upward toward the top panel 14. The resiliency of each spring 108, 110 opposes this deflection, meaning that the springs 108, 110 force the empty magazine 106 downward toward the bottom panel 15 of the container when the magazine is inserted.

Figure 21:
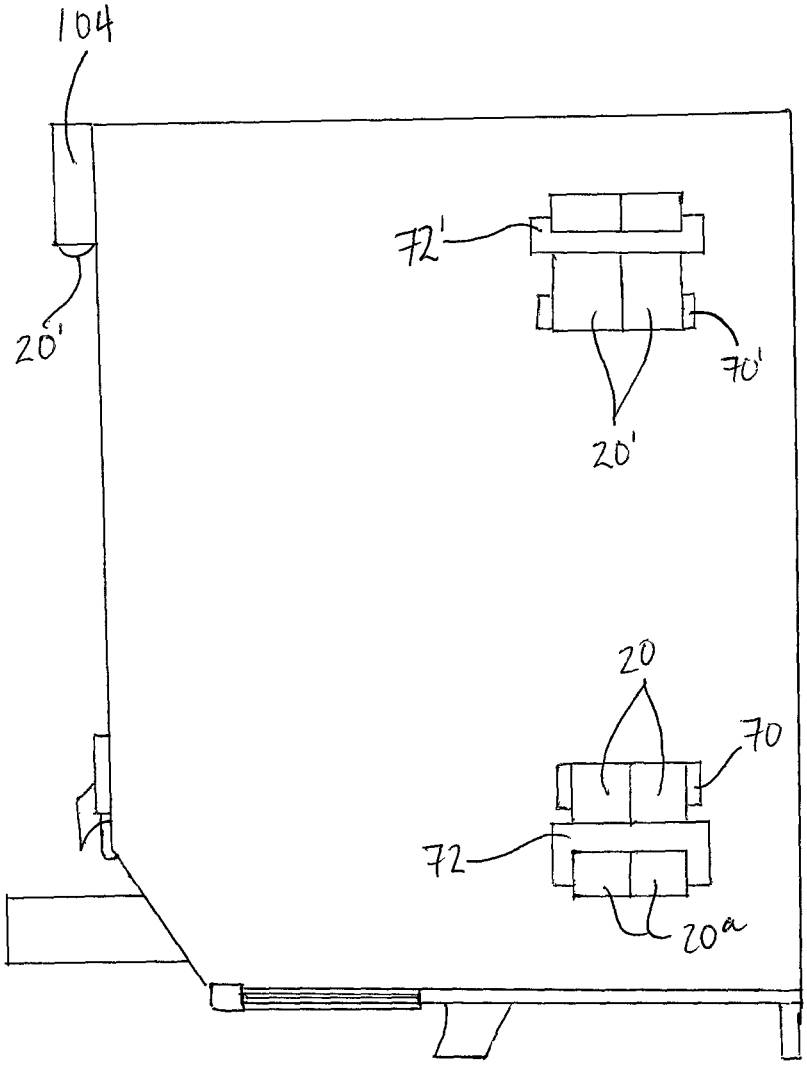
FIG. 21 is a back view of the sixth embodiment container with the back wall intact.

The sixth embodiment features a second constant force block 60' of the same structure as that of the first block 60 which biases the stack of full magazines downwardly toward the ejection port, except that the second block 60' is vertically inverted so that the spring-containing cavities are in the bottom of the block, where pins passing through the center openings of the spiral constant force springs retain the springs in place to prevent them from falling from the block 60'. The springs 20' of the second block act to bias the block 60' upwardly toward the top panel 14, but only up to height generally flush with, or slightly below, the bottom edge of the insertion port 102. The spring at the forward end of the block 60' hooks over the lower edge of the insertion port 102 to then pass downwardly through a slot in the lower side of the insertion guide 104 to hook under the same, thus forming a connection to the forward panel in a manner similar to the front end spring of the first block 60. With reference to FIG. 21, the two cavity mounted springs near the rearward end of each side of the block are connected to the respective front or rear wall of the container in the same manners as the side springs of the first block 60. That is, a second spring opening 70' in each of the front and rear walls is located near the rearward panel 10, with a top edge of this opening 70' lying at or slightly below the height of the bottom edge of the insertion port 102, and a sleeve 72' disposed a short distance above the top edge of the spring opening 70' is open at its top and bottom ends. The springs transition from their connection to the block 60' inside the container to the exterior of the container through the opening 70', then continue upward through the sleeve 72', where the springs are bent to hook around the top end of the sleeve to secure these bent ends of the springs to the respective container wall.

The second spring opening 70' of each wall may be covered in a waterproof fashion, for example in the same manner as described for the first spring openings 70. Likewise, the insertion port 102 may feature a selectively closeable, spring biased, normally-open waterproof cover configuration similar to that employed at the ejection port, so as to keep the insertion port 102 open and ready for use by default, but allowing closure of the port at other times to protect the container interior from the elements.

The downward spring force acting on an inserted empty magazine by the spring strips 108, 110 exceeds the upward spring force acting on the second block 60' by the constant force springs 20'. With reference to FIG. 19, when the empty magazine is inserted into the container, it slides onto the second block 60' that lies just below the insertion port 20. The second block 60' thus forms a platform or support onto which the empty magazine is received. Turning to FIG. 20, when the second end of the magazine clears the insertion port 102, the downward force applied on the magazine by the spring strips 108, 110 forces the magazine and the support block 60' therebeneath downward, thus displacing the magazine down past the bottom of the insertion port. This way, the inserted magazine does not obstruct the insertion port and interfere with subsequent insertion of another empty magazine. The first inserted magazine forms the platform or support onto which the next magazine is then slid when introduced to the container through the insertion port. As the magazines initially deployed from the container through the ejection port are used up, the used magazines are thus reintroduced to the container through the insertion port and stacked with one another atop the support block 60'.

The support block 60' acts to prevent the first-inserted end of any inserted magazine from free falling inside the container, which may otherwise cause the magazine to become lodged in an improper orientation preventing clean stacking of the used magazines atop one another. If each and every magazine dispensed from the container is re-introduced through the insertion port, and the first block 60 is arranged to reside at the bottom of the insertion port either initially or after dispensing of the first magazine through the ejection port, then a second block 60' for supporting the empty magazines may not be necessary, as the first empty magazine will slide onto the first block 60 when inserted. However, the use of the second block ensures that any inserted magazine will be in the proper orientation inside the container, regardless of whether any previously dispensed and emptied magazines were inserted back into the container. The first empty magazine inserted into the container after removal from the firearm may of course be a magazine that was not dispensed from that particular container, provided that if the container started in a fully loaded condition, a first full magazine has been removed the container to create space for the first empty magazine from the firearm.

While the illustrated embodiments employ a ramp-like inclined plane to perform the automatic partial-ejection of each magazine, other partial-ejection mechanisms are contemplated within the scope of the present invention. For example, other embodiments may employ a moving actuator configured to automatically provide a motive action conveying the magazine toward the ejection port when a magazine reaches the bottom panel. In one such embodiment, a solenoid mounted in a position placing its output plunger at or behind the inner face of the rearward panel when retracted may be configured to extend its output plunger against the corresponding end of the magazine when a suitable sensor or detector is triggered by the magazine's arrival at the bottom panel of the container. However, the use of the ramp of the illustrated embodiments presents the advantages of avoiding the need for an electrical power source, and associated risks of the overall device becoming inoperable by way of an electrical short, dead battery, or other electrical-related issue.

The above embodiments of the present invention present several advantages over the aforementioned prior art of Carroll:

a. Instead of front to back orientation the disclosed embodiments of the present invention stacks the magazines in a side by side or parallel relationship detailed above. This allows for a rather significant increase in the magazine capacity to size of the container ratio and allows the containers curvature to increase making it usable on the operators thighs. It also decreases the size of the magazine port making foreign objects less likely to enter the container.

b. Instead of an elongated compression spring the disclosed embodiments of the present invention use constant force spring force to maintain consistent magazine tension. This constant force applied to the magazines creates a tension that makes every magazine removal by the operator identical allowing a more standardized operation. Constant force springs are smaller in size, increasing the container's magazine capacity by using less room in the magazine storing compartment.

c. The use of stop flanges in Carroll requires the operator to pass one or more of their fingers behind the magazine and apply a outward pressure on the magazine to remove it from the carrier. Instead the disclosed embodiments of the present invention only require that the operator grasp the already partially ejected magazine and pull it straight out with out having to pass fingers through any stop flanges or retaining system, making the removal of magazines faster and easer.

d. The multiple magazine carrier and dispenser for fire arms in Carroll, in its straight configuration of FIG. 5, is described as not so convenient for carrying on the person. However, the straight container embodiments of the present invention are ideal for wearing as a backpack.

e. There is no ability to take stock of the magazines left in Carroll's multiple magazine carrier and dispenser for fire arms. The present invention may employ translucent walls and or panels to see how many magazines are remaining in the container.

f. Carroll's multiple magazine carrier and dispenser for fire arms cannot be used while wearing mittens or if placed in a location out of reach to the operator. The disclosed embodiments of the present invention use a forward-assist mechanism to eject magazines out of the container completely if required or until the operator is able to grasp it.

The above embodiments of the present invention present several advantages over the aforementioned prior art of Burdine:

a. Burdine uses compression springs which make it more difficult to remove magazines when filled to a higher capacity and more likely to accidentally dispense a magazine when nearly depleted due to the lack of spring force. However the disclosed embodiments of the present invention use a constant force plate, making the magazines more secure and easily removed through out the operation of the present invention from the first magazine to the last.

b. Burdine's open design allows foreign objects such as dirt, snow, water, sand to enter the container at any time and creates the possibly of jamming or difficultly removing a magazine. The disclosed embodiments of the present invention can be sealed until needed, allowing no foreign objects into the container.

c. Burdine requires the operator to use their hands fingers or thumb to slide a magazine or clip out manually, and while doing so, depressing the magazine too far while trying to remove it can cause the magazine to come into contact with the carrier's panels. Instead the disclosed embodiments of the present invention use an automatic ejection system so the operator cannot make a mistake and does not have to focus on the removal of the magazine out of the container, thereby saving time.

d. Burdine is designed to be used on the operator's belt using a clip attached to the container. Instead, the disclosed embodiments of the present invention allow for individual preference of orientation and location on the operators body by using attachments located on the walls and or panels of the container or a torso, leg or shoulder harness assembly extending from the container.

e. Burdine provides no ability to take stock of the magazines left in the container. The present invention may have translucent walls and or transparent panels to see how many magazines are remaining in the container.

In conclusion, the present multiple magazine self dispensing container in it various embodiments, provides more magazines in less time with greater reliability to the operator. The present invention responds to these shortcomings of the prior art by providing a multiple magazine self dispensing container for firearms, which partially dispenses magazines automatically to the operator from a single location, which may be of their choosing. The magazines are held in place by the constant force exerted on them by the constant force member instead of compression springs or flaps. This means that all the magazines are held in place securely by the same amount of force, making their removal by the operator simple and reliable.

The magazines are partially ejected from the container by the inclined plane and the force from the constant force member. This allows the operator to remove the magazine by pulling it straight out, with another magazine instantly taking its place. This process can be repeated until the container is depleted, allowing the operator to put more rounds on target in less time then a traditional vest, pouch or other multiple magazine carriers. In a relatively stationary embodiment the present invention can automatically dispense magazines to a group of operators in close proximity to the container allowing them to reduce the weight carried by the operator.

The multiple magazine self dispensing container automatically dispenses a plurality firearm magazines that are properly orientated sequentially to the operator to rapidly be loaded into a firearm. The present invention may be made ambidextrous by mounting it on the operator using the attachments on the walls and panels with the magazine ejection port facing the desired direction. The magazines are automatically partially ejected by the constant force plate urging the magazines to slide out on an incline plane opposite a magazine ejection port. The present invention contemplates several embodiments including straight, left-hand, right-hand and a relatively stationary configuration.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A multiple magazine self dispensing container that automatically dispenses firearm magazines of a predetermined size, the multiple magazine self dispensing container comprising:

a container defining an inner compartment having, on respective sides thereof, a front wall, a back wall opposite the front wall, a forward panel, a rearward panel opposite the forward panel, and a bottom panel, the inner compartment being dimensioned for containing a stack of the magazines;

a magazine ejection port on the container located opposite the rearward panel between the forward panel and the bottom panel;

a force application member disposed within the compartment;

one or more constant force springs connected between the container and the force application member and biasing the force application member toward the bottom panel to urge the stack of magazines stored within the container toward the bottom panel with constant force, regardless of the number of magazines in the stack; and a planar ramp located inside the inner compartment of the container at a position opposite the magazine ejection port and sloping downward from the rearward panel to the bottom panel at a continuous linear slope, the planar ramp being operable to automatically convey a lowermost magazine of the stack nearest the bottom panel toward and partially through the magazine ejection port into a partially ejected state protruding from the container;

wherein a port height of the magazine ejection port, measured in a height direction of the container in which the bottom panel is spaced from an opposing top end of the inner compartment, is greater than a corresponding magazine height of the magazines and less than twice said magazine height, and a height dimension of the ramp measured in the height direction of the container is less than said port height and less than said magazine height, whereby the firearm magazines of predetermined size are brought into contact with the ramp, and partially ejected through the port, only one at a time.

2. The multiple magazine self dispensing container of claim 1 wherein at least one spring of the one or more constant force springs runs along a respective one of the walls and panels and transitions from inside the compartment, where said at least one spring connects to the force application member, to outside the compartment through at least one spring opening situated in the respective one of the walls or panels at a distance from the bottom panel.

3. The multiple magazine self dispensing container of claim 1 wherein each of the one or more constant force springs has one end thereof secured to the container and a spiraled portion that is cavity mounted in the force application member.

4. The multiple magazine self dispensing container of claim 1 wherein the at least a portion of one or more of the walls or panels of the container is transparent or translucent to provide a viewing window for visual confirmation of a number of magazines in the compartment.

5. The multiple magazine self dispensing container of claim 1 comprising an environmental cover movable between a closed position sealed over the magazine ejection port and an open position revealing the magazine ejection port.

6. The multiple magazine self dispensing container of claim 5 wherein the environmental cover is externally mounted to move out of the closed position in a same direction in which the magazines are ejected through the ejection port.

7. The multiple magazine self dispensing container of claim 6 comprising a latch operable to secure the environmental cover in the closed position, and wherein the environmental cover is spring biased toward the open position.

8. The multiple magazine self dispensing container of claim 1 comprising an ejection assist mechanism mounted on the container and operable to convey the lowermost magazine further through the ejection port from the partially ejected state.

9. The multiple magazine self dispensing container of claim 8 wherein the ejection assist mechanism comprises a handle accessible outside the container for manual sliding along the bottom panel between a normal position and a magazine ejecting position, the handle being biased into the normal position for automatic return thereto from the magazine electing position.

10. The multiple magazine self dispensing container of claim 9 wherein the ejection assist mechanism is configured to displace a conveying member thereof toward the ejection port along the bottom panel inside the compartment under drawing of the handle in an opposite direction away from the ejection port along the bottom panel outside the compartment.

11. The multiple magazine self dispensing container of claim 1 wherein the force application member is dimensioned to prevent automatic conveyance of the force application member through the ejection port by the magazine ejector.

12. The multiple magazine self dispensing container of claim 11 wherein the force application member is dimensioned to abut against the forward panel when conveyed toward the ejection port by the magazine ejector.

13. The multiple magazine self dispensing container of claim 1 comprising an empty magazine insertion port in the container located at a distance from the bottom panel and on side of the force application member opposite the bottom panel, the empty magazine insertion port being sized for insertion of an empty one of the magazines back into the compartment for storage on the side of the force application member opposite the bottom panel.

14. The multiple magazine self dispensing container of claim 13 wherein the insertion port is located in one of the forward panel, rearward panel, front wall and rear wall, and the container comprises upper spring members at a top panel lying opposite the bottom panel to force the empty magazine toward the bottom panel under insertion of the empty magazine to the compartment through the insertion port.

15. The multiple magazine self dispensing container of claim 14 comprising an empty magazine support movably disposed between the force application member and the insertion port and biased toward the insertion port in a direction toward the top panel, a biasing force of the empty magazine support toward the top panel being less than an opposing spring force provided by the upper spring members, whereby the empty magazine support maintains an orientation of the empty magazine as it enters the insertion port and is displaceable against the biasing force to allow stacking of multiple empty magazines between the empty magazine support and the top panel.

16. In combination, firearm magazines of a predetermined size and a multiple magazine self dispensing container that automatically dispenses said firearm magazines, the multiple magazine self dispensing container comprising:

a container defining an inner compartment having, on respective sides thereof, a front wall, a back wall opposite the front wall, a forward panel, a rearward panel opposite the forward panel, and a bottom panel, the inner compartment containing a stack of said magazines of predetermined size;

a magazine ejection port on the container located opposite the rearward panel between the forward panel and the bottom panel;

a force application member disposed within the compartment;

one or more constant force springs connected between the container and the force application member and biasing the force application member and biased toward the bottom panel to urge the stack of magazines toward the bottom panel with constant force, regardless of the number of magazines in the stack; and a planar ramp located inside the inner compartment of the container at a position opposite the magazine ejection port and sloping downward from the rearward panel to the bottom panel at a continuous linear slope, the planar ramp being and operable to automatically convey a lowermost magazine of the stack nearest the bottom panel toward and partially through the magazine ejection port into a partially ejected state protruding from the container;

wherein a port height of the magazine ejection port, measured in a height direction of the container in which the bottom panel is spaced from an opposing top end of the inner compartment, is greater than a corresponding magazine height of the magazines and less than twice said magazine height, and a height dimension of the ramp measured in the height direction of the container is less than said port height and less than said magazine height, whereby the firearm magazines of predetermined size are brought into contact with the ramp, and partially ejected through the port, only one at a time.

* * * * *